US007939740B2

(12) United States Patent
Usa et al.

(10) Patent No.: US 7,939,740 B2
(45) Date of Patent: May 10, 2011

(54) ENSEMBLE SYSTEM

(75) Inventors: Satoshi Usa, Hamamatsu (JP); Tomomitsu Urai, Hamamatsu (JP)

(73) Assignee: Yamaha Corporation (JP)

( * ) Notice: Subject to any disclaimer, the term of this patent is extended or adjusted under 35 U.S.C. 154(b) by 44 days.

(21) Appl. No.: 12/066,519

(22) PCT Filed: Jul. 24, 2006

(86) PCT No.: PCT/JP2006/315070

§ 371 (c)(1),
(2), (4) Date: Mar. 12, 2008

(87) PCT Pub. No.: WO2007/032155

PCT Pub. Date: Mar. 22, 2007

(65) Prior Publication Data

US 2009/0044685 A1 Feb. 19, 2009

(30) Foreign Application Priority Data

Sep. 12, 2005 (JP) ..... 2005-263144

(51) Int. Cl.
*G10H 1/00* (2006.01)

(52) U.S. Cl. ..... 84/600; 84/609; 84/649

(58) Field of Classification Search ..... 84/600–602, 84/609, 649

See application file for complete search history.

(56) References Cited

U.S. PATENT DOCUMENTS 3,808,936 A * 5/1974 Shrader ..... 84/471 R
3,823,637 A * 7/1974 Scott ..... 84/470 R
3,895,555 A * 7/1975 Peterson et al. ..... 84/470 R
3,919,913 A * 11/1975 Shrader ..... 84/454
4,364,299 A * 12/1982 Nakada et al. ..... 84/478
4,694,723 A 9/1987 Shinohara et al.
4,781,099 A * 11/1988 Koike ..... 84/470 R
5,002,491 A 3/1991 Abrahamson et al.
5,728,960 A 3/1998 Sitrick (Continued)

FOREIGN PATENT DOCUMENTS

EP 0 933 906 A2 8/1999

(Continued)

OTHER PUBLICATIONS

International Search Report issued in corresponding application No. PCT/2006/315070.

(Continued)

*Primary Examiner* — David S. Warren

(74) *Attorney, Agent, or Firm* — Rossi, Kimms & McDowell LLP

(57) ABSTRACT

An electronic musical instrument is provided, which makes it possible to manage a state of attendance (presence/absence, etc.) of participants and perform easy management on the level of activity on a daily, weekly, or monthly basis. According to performance operations on performance terminals 2, a controller 1 records a performance history. Performance terminals 2 to which performance parts have been assigned by a Facilitator are determined as being present, whereas performance terminal 2 to which no performance parts have been assigned are determined as being absent. The number of times of key depression on each performance terminal 2, the average key depression intensity (average Velocity), etc. from start to end of a performance are recorded. The recorded values for respective items are output in the form of text data. Since values for the respective item are recorded at every performance, the frequency of attendance of respective users can easily be managed on a daily, weekly, or monthly basis.

8 Claims, 12 Drawing Sheets

| DATE Y/M/D | DAY OF WEEK | TIME | PRESENCE /ABSENCE (Fa) | PRESENCE /ABSENCE (P1) | . . . | Keyon (Fa) | Keyon (P1) | . . . | AVERAGE V(Fa) | AVERAGE V(P1) | . . . | AVERAGE DEVIATION (P1) | AVERAGE DEVIATION (P2) | . . . |
|---|---|---|---|---|---|---|---|---|---|---|---|---|---|---|
| 05/7/6 | Wed | 16:33 | 1 | 1 | | 11 | 11 | | 61 | 52 | | | | |
| 05/7/7 | Thu | 9:45 | 1 | 0 | | 65 | 0 | | 112 | 0 | | | | |
| 05/7/7 | Thu | 10:30 | 1 | 1 | | 85 | 84 | | 88 | 49 | | | | |
| ⋮ | | | | | | | | | | | | | | |

U.S. PATENT DOCUMENTS

| | | | | |
|---|---|---|---|---|
| 5,952,597 | A | 9/1999 | Weinstock et al. | |
| 5,980,261 | A * | 11/1999 | Mino et al. | 434/307 A |
| 6,084,168 | A | 7/2000 | Sitrick | |
| 6,198,034 | B1 | 3/2001 | Beach et al. | |
| 6,211,451 | B1 | 4/2001 | Tohgi et al. | |
| 6,348,648 | B1 | 2/2002 | Connick, Jr. | |
| 6,417,435 | B2 * | 7/2002 | Chantzis et al. | 84/477 R |
| 6,438,611 | B1 | 8/2002 | Hara et al. | |
| 6,441,289 | B1 * | 8/2002 | Shinsky | 84/464 R |
| 6,448,486 | B1 * | 9/2002 | Shinsky | 84/613 |
| 6,495,747 | B2 | 12/2002 | Shimaya et al. | |
| 6,504,090 | B2 * | 1/2003 | Tsai et al. | 84/615 |
| 6,660,922 | B1 | 12/2003 | Roeder | |
| 6,751,439 | B2 * | 6/2004 | Tice et al. | 434/350 |
| 6,921,856 | B2 * | 7/2005 | Koseki | 84/603 |
| 6,995,311 | B2 * | 2/2006 | Stevenson | 84/737 |
| 7,074,999 | B2 | 7/2006 | Sitrick et al. | |
| 7,098,392 | B2 | 8/2006 | Sitrick et al. | |
| 7,157,638 | B1 | 1/2007 | Sitrick | |
| 7,189,910 | B2 * | 3/2007 | Hasegawa | 84/601 |
| 7,297,856 | B2 | 11/2007 | Sitrick | |
| 7,335,833 | B2 | 2/2008 | Smith et al. | |
| 7,423,213 | B2 | 9/2008 | Sitrick | |
| 7,612,278 | B2 | 11/2009 | Sitrick | |
| 2001/0007960 | A1 | 7/2001 | Yoshihara et al. | |
| 2001/0032539 | A1 * | 10/2001 | Chantzis et al. | 84/478 |
| 2002/0035916 | A1 * | 3/2002 | Tsai et al. | 84/622 |
| 2002/0144586 | A1 | 10/2002 | Connick, Jr. | |
| 2002/0157521 | A1 | 10/2002 | Shahal | |
| 2002/0165921 | A1 | 11/2002 | Sapieyevski | |
| 2003/0000368 | A1 | 1/2003 | Isozaki | |
| 2003/0024375 | A1 | 2/2003 | Sitrick | |
| 2003/0100965 | A1 | 5/2003 | Sitrick et al. | |
| 2003/0110925 | A1 | 6/2003 | Sitrick et al. | |
| 2003/0110926 | A1 | 6/2003 | Sitrick et al. | |
| 2003/0150317 | A1 | 8/2003 | Hamilton | |
| 2003/0167904 | A1 | 9/2003 | Itoh | |
| 2003/0167906 | A1 * | 9/2003 | Isozaki | 84/615 |
| 2003/0177886 | A1 * | 9/2003 | Koseki | 84/600 |
| 2003/0182133 | A1 | 9/2003 | Kawashima et al. | |
| 2003/0188626 | A1 * | 10/2003 | Kriechbaum et al. | 84/609 |
| 2004/0055443 | A1 | 3/2004 | Nishitani et al. | |
| 2004/0112202 | A1 | 6/2004 | Smith et al. | |
| 2004/0187673 | A1 * | 9/2004 | Stevenson | 84/737 |
| 2004/0221708 | A1 * | 11/2004 | Hasegawa | 84/601 |
| 2004/0237756 | A1 * | 12/2004 | Forbes | 84/477 R |
| 2005/0005761 | A1 * | 1/2005 | Knudsen | 84/645 |
| 2005/0120865 | A1 | 6/2005 | Tada | |
| 2005/0172790 | A1 | 8/2005 | Tada | |
| 2005/0262989 | A1 * | 12/2005 | Franzblau | 84/470 R |
| 2006/0117935 | A1 | 6/2006 | Sitrick | |
| 2006/0213358 | A1 | 9/2006 | Motsenbocker | |
| 2006/0288842 | A1 | 12/2006 | Sitrick et al. | |
| 2007/0089590 | A1 * | 4/2007 | Katou | 84/609 |
| 2008/0041217 | A1 * | 2/2008 | Knudsen | 84/464 R |
| 2008/0060499 | A1 | 3/2008 | Sitrick | |
| 2008/0065983 | A1 | 3/2008 | Sitrick | |
| 2008/0072156 | A1 | 3/2008 | Sitrick | |
| 2008/0134861 | A1 | 6/2008 | Pearson | |
| 2009/0044685 | A1 * | 2/2009 | Usa et al. | 84/600 |

FOREIGN PATENT DOCUMENTS

| | | | |
|---|---|---|---|
| EP | 1 553 556 | A1 | 7/2005 |
| EP | 1 562 175 | A1 | 8/2005 |
| EP | 1 926 080 | A1 | 5/2008 |
| JP | 07-261757 | A | 10/1995 |
| JP | 8-16160 | A | 1/1996 |
| JP | 2000-276141 | A | 10/2000 |
| JP | 2001-337675 | A | 12/2001 |
| JP | 2002-91290 | A | 3/2002 |
| JP | 2002-132137 | A | 5/2002 |
| JP | 2003-084760 | A | 3/2003 |
| JP | 2003-288077 | A | 10/2003 |
| JP | 2004-093613 | A | 3/2004 |
| JP | 2004-184757 | A | 7/2004 |
| JP | 2005-62697 | A | 3/2005 |
| JP | 2005-165078 | A | 6/2005 |
| JP | 2005-250053 | A | 9/2005 |
| KR | 10-1996-0702658 | A | 4/1996 |
| KR | 10-2001-0109498 | A | 12/2001 |
| KR | 10-2003-0076405 | A | 9/2003 |
| WO | 9428539 | A2 | 12/1994 |
| WO | 0193261 | A1 | 12/2001 |

OTHER PUBLICATIONS

International Search Report issued in PCT/JP2006/315077, dated Oct. 31, 2006, which corresponds to related co-pending U.S. Appl. No. 12/088,306.

Specification and drawings of un-published related co-pending U.S. Appl. No. 12/088,306 filed Mar. 27, 2008. "Ensemble System"; Satoshi Usa et al.

International Search Report issued in PCT/JP2006/315075, dated Oct. 31, 2006, which corresponds to related co-pending U.S. Appl. No. 12/088,430.

Specification and drawings of un-published related co-pending U.S. Appl. No. 12/088,430 filed Mar. 27, 2008. "Ensemble System"; Satoshi Usa et al.

English translation of the International Preliminary Report issued in corresponding application No. PCT/JP2006/315070, mailed Mar. 27, 2008.

English translation of the International Preliminary Report corresponding to related co-pending U.S. Appl. No. 12/088,306, Apr. 10, 2008.

English translation of the International Preliminary Report corresponding to related co-pending U.S. Appl. No. 12/088,430, Apr. 10, 2008.

Korean Office Action for Application No. 10-2008-7008627, "Ensemble System", Jul. 30, 2009. (Partial Translation).

Korean Office Action for Application No. 10-2008-7007402, "Ensemble System", Jul. 29, 2009. (Partial Translation).

Extended European Search Report issued in corresponding European Patent Application No. 06768386.2 dated Jul. 7, 2010, which corresponds to related co-pending U.S. Appl. No. 12/088,306.

Extended European Search Report issued in corresponding European Patent Application No. 06768384.7 dated Jul. 13, 2010, which corresponds to related co-pending U.S. Appl. No. 12/088,430.

Extended European Search Report issued in corresponding European Patent Application No. 06768379.7 dated Jun. 25, 2010.

Notification of Reasons for Rejection dated Jan. 18, 2011 issued in corresponding Japanese Patent Application No. 2005-281060, which is cited in related co-pending U.S. Appl. No. 12/088,306. Full English translation is provided.

* cited by examiner

FIG. 5

PART ASSIGNMENT TABLE

| PART ID | MIDI PORT |
|---|---|
| 1 | 0 (FACILITATOR) |
| 2 | 1 (PIANO 1) |
| 3 | 2 (PIANO 2) |
| 4 | 3 (PIANO 3) |
| 5 | 4 (PIANO 4) |
| 6 | 5 (PIANO 5) |

*FIG. 11*

| DATE Y/M/D | DAY OF WEEK | TIME | PRESENCE /ABSENCE (Fa) | PRESENCE /ABSENCE (P1) | . . . | Keyon (Fa) | Keyon (P1) | . . . | AVERAGE V(Fa) | AVERAGE V(P1) | . . . | AVERAGE DEVIATION (P1) | AVERAGE DEVIATION (P2) | . . . |
|---|---|---|---|---|---|---|---|---|---|---|---|---|---|---|
| 05/7/6 | Wed | 16:33 | 1 | 1 | | 11 | 11 | | 61 | 52 | | | | |
| 05/7/7 | Thu | 9:45 | 1 | 0 | | 65 | 0 | | 112 | 0 | | | | |
| 05/7/7 | Thu | 10:30 | 1 | 1 | | 85 | 84 | | 88 | 49 | | | | |
| ⋮ | | | | | | | | | | | | | | |

ENSEMBLE SYSTEM

This application is a U.S. National Phase Application of PCT International Application PCT/JP2006/315070 filed on Jul. 24, 2006 which is based on and claims priority from JP 2005-263144 filed on Sep. 12, 2005, the contents of which is incorporated herein in its entirety by reference.

TECHNICAL FIELD

The present invention relates to an ensemble system that enables even a performer unfamiliar with operation of musical instrument to easily participate in an ensemble performance, and more particularly, to an ensemble system capable of realizing easy management of a performance history.

BACKGROUND ART

Conventionally, there is known an electronic musical instrument for generating music sounds according to performer's operations. Such instrument is generally modeled on piano, for example, and adapted to be operated similarly to a natural piano instrument. Therefore, some level of skill is needed to play the instrument and a long time is required to acquire proficiency in playing it.

In recent years, on the other hand, a musical instrument has been demanded which can be played even by a performer unfamiliar with operating musical instrument. Also, there is a demand for a musical instrument that enables not only a performer to enjoy playing music, but also many performers to participate in an ensemble performance.

To this end, there has been proposed in, for example, Japanese Laid-open Patent Publication No. 2000-276141, an electronic musical instrument that enables a plurality of users unfamiliar with operating musical instrument to participate in a performance.

With this electronic musical instrument, users are enabled to implement an ensemble performance by making some easy actions (such as waving their hands). Since the users are capable of performing exercise (performance operations) while enjoying themselves, this musical instrument is used for rehabilitation exercise (hereinafter simply referred to as "rehabilitation"), wellness activity, etc.

In the case of using an electronic musical instrument for rehabilitation or wellness activity, it is desired that information on respective users can be collected. For example, to evaluate changes in mental and physical functions of respective users before and after every performance, such electronic musical instrument is demanded to be able to collect data on mental and physical functions such as heart rate of each user.

In Japanese Laid-open Patent Publication No. 2004-93613, for example, there is proposed a performance processing apparatus capable of collecting information on respective users. This apparatus detects user's performance actions and physical states, and records performance parameters (music data for evaluation) based on the detected actions and states. The music data for evaluation is compared with standard music data, whereby it is evaluated.

In a case that a plurality of users (participants) perform rehabilitation or other activity together, the users are often divided into groups each consisting of a predetermined number of performers (about five performers, for example) including a facilitator (guide) who guides other participants. The facilitators manage a state of attendance (presence/absence or the like) of participants and also manage the level of activity on a daily, weekly, or monthly basis.

With the above described electronic musical instrument, participants can easily implement an ensemble performance, however, it is difficult for the facilitators to manage a state of attendance of the participants. A possible choice is to take a record of attendance by a receptionist, for example.

With the above described performance processing apparatus, data for evaluation of mental and physical functions can be collected, however, a state of attendance (presence/absence, etc.) of participants cannot be managed and the level of activity cannot be managed on a daily, weekly, or monthly basis.

The object of the present invention is to provide an ensemble system capable of managing a state of attendance (presence/absence, etc.) of respective participants and managing the level of activity on a daily, weekly, or monthly basis with ease.

DISCLOSURE OF THE INVENTION

To achieve the above object, an ensemble system of this invention comprises a plurality of performance terminals each having at least one performance operator unit used for performance operation, at least one tone generator, and a controller connected to the plurality of performance terminals and the at least one tone generator and adapted to control each of the performance terminals, wherein the controller includes storage means adapted to store music data for performance including a plurality of performance parts, operation means adapted to give instructions to start and stop a performance, performance control means adapted to assign the plurality of performance parts to respective ones of the plurality of performance terminals, read out the performance part assigned to each of the performance terminals in accordance with a way in which the performance operator unit of each of the performance terminals is operated, and output data of the read-out performance part to the tone generator, and record means adapted to record whether each of the performance terminals is in use or nonuse and record a performance history for each of the performance terminals from start to completion of the performance.

In this invention, a user instructs the start of a performance using the operation means of the controller, and performs a performance operation using the performance operator unit of the performance terminal. The performance operator unit of the performance terminal is comprised of a keyboard of an electronic piano, for example. When a key of any of the keyboards is depressed, an operation signal is transmitted to the controller. Based on the received operation signal, the controller transmits a sounding instruction to the tone generator. In response to the sounding instruction, the tone generator sounds music sound. When an instruction to stop the performance is given by the user, whether or not each performance terminal has participated in the performance is recorded in a memory of the controller or the like, whereby a facilitator who guides a group is enabled to easily manage a state of attendance (presence/absence) of participants. Furthermore, when the instruction to stop the performance is given, a performance history for the performed music piece is recorded. With reference to the record on a daily, weekly, or monthly basis, a change in a state of performance of each participant can easily be managed.

In this invention, preferably, the tone generator is built in each of the plurality of performance terminals, and the performance control means of the controller is adapted to output information on the read-out performance part to the tone generator built in the performance terminal to which the performance part is assigned.

With the above preferred embodiment, based on the operation signal received from the performance terminal, the controller reads out the performance part assigned to the performance terminal and transmits data on the read-out performance part to the tone generator built in the performance terminal. Music sound is sounded by the built-in tone generator of the performance terminal in accordance with a received sounding instruction. As a result, respective performance parts are sounded by the corresponding performance terminals.

In this invention, preferably, the performance history includes information representing number of times of and average intensity of performance operation.

With the above preferred embodiment, the performance history includes information representing the number of times of performance operation (for example, key depression) and average intensity of performance operation (key depression intensity). Since the information on the number of times of and average intensity of performance operation is recorded, the level of physical activity can easily be managed. With reference to the recorded information on a daily, weekly, or monthly basis, changes in the level of physical activity and key depression intensity can also easily be managed.

In this invention, preferably, the performance history includes information representing an average deviation relative to the performance operation on a guide performance terminal among the performance terminals.

With this preferred embodiment, information representing an average deviation relative to a reference performance terminal is recorded as the performance history. The reference performance terminal is a performance terminal for use by a facilitator, for example. Since the information representing the average deviation is recorded, the level of performance (ensemble performance) can be managed. With reference to the recorded information on a daily, weekly, or monthly basis, the degree of progress of performance can also easily be managed.

BRIEF DESCRIPTION OF DRAWINGS

FIG. 5 is a view showing an example of apart assignment table;

FIG. 11 is a view showing an example of a performance history; and

BEST MODE FOR CARRYING OUT THE INVENTION

In the following, an embodiment of this invention will be described in detail with reference to the drawings.

Figure 1:
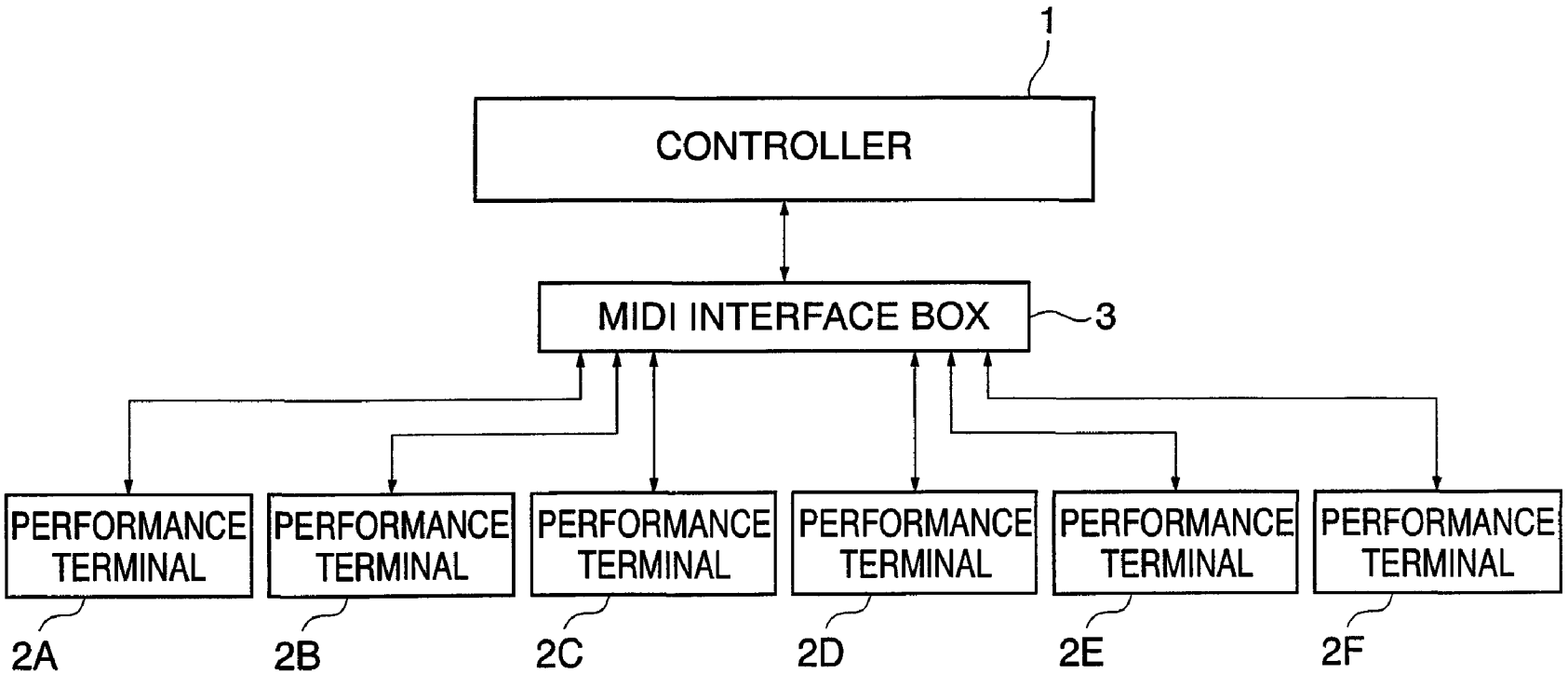
FIG. 1 is a block diagram showing the construction of a performance system.

FIG. 1 is a block diagram showing the construction of an ensemble system. As shown in FIG. 1, the ensemble system includes a controller 1 and a plurality of (six in FIG. 1) performance terminals 2A to 2F connected to the controller 1 via a MIDI interface box 3. Among the performance terminals 2, the performance terminal 2A is for use by a facilitator (guide), and the performance terminals 2B to 2F are for use by participants (educands). Five participants using the performance terminals 2B to 2F always use the same performance terminals 2, whereby the facilitator can identify the participants based on the performance terminals used by them.

The controller 1 is implemented by, for example, a personal computer, and controls the performance terminals 2 and collects data using software installed thereon. The controller 1 stores pieces of music data for performance each consisting of a plurality of performance parts. These parts include one or more melody parts, rhythm parts, accompaniment parts, and so on. The controller 1 includes a communication unit 11, described below, for transmitting sounding data for a part (or parts) to a corresponding one or ones of the performance terminals 2.

The performance terminals 2 are used by users to implement performance operations, and generate music sounds in accordance with users' performance operations. Each of the performance terminals is constituted by, for example, an electronic piano or some other electronic keyboard instrument. In this embodiment, using the MIDI interface box 3 USB-connected to the controller 1, the performance terminals 2 are connected via separate MIDI systems. In FIG. 1, the performance terminal 2A is for use by the facilitator, and the performance terminal for the facilitator is specified by the controller 1. The performance terminals 2 are not limited to electronic pianos but may be other forms of electronic musical instruments such as electronic guitars, and in appearance, these terminals may not be limited to natural musical instruments but may be terminals each simply having an operator unit such as button.

It should be noted that the performance terminals 2 are not limited to those each having a tone generator incorporated therein. Alternatively, one or more independent tone generators can be connected to the controller 1. In that case, a single or as many tone generators as the performance terminals 2 may be connected to the controller 1. If as many tone generators as the performance terminals 2 are connected, these tone generators are respectively assigned to the performance terminals 2, and parts of music data for performance are assigned by the controller 1.

In the ensemble system, performance parts of music data for performance stored in the controller 1 are respectively assigned to the performance terminals 2, and each performance terminal 2 carries out an automatic performance of the performance part uniquely assigned thereto. When a performance operation (for example, key depression on the electronic piano) is performed by any of users of the performance terminals 2, instructions on tempo and timing are transmitted to the controller 1. Based on the input instructions on tempo and timing, a sounding instruction to sound notes of the performance part assigned to the performance terminal 2 is transmitted from the controller 1 to the performance terminal 2. An automatic performance is performed by the performance terminal 2 based on the sounding instruction received. Educands who are using the performance terminals 2 adjust tempos such as to match the tempo of the facilitator, whereby an ensemble performance is realized. The following is a detailed description of the constructions of the controller 1 and the performance terminal 2.

Figure 2:
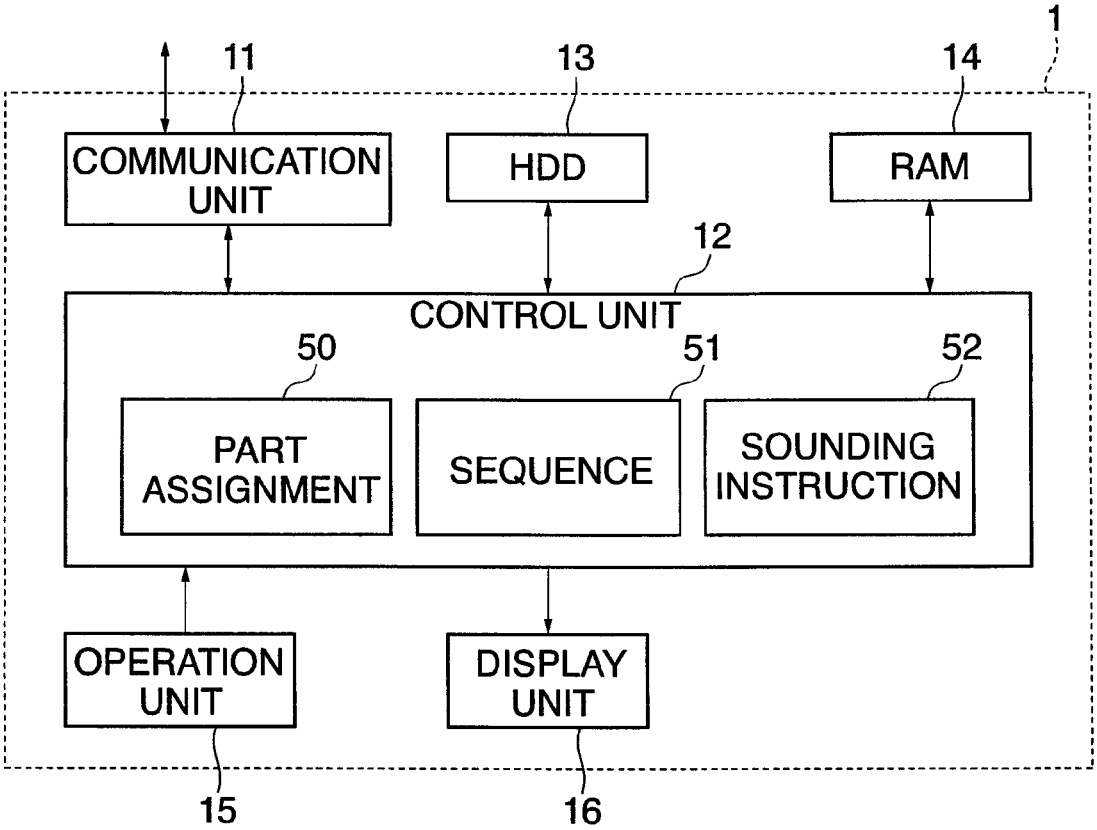
FIG. 2 is a block diagram showing the construction of a controller.

FIG. 2 is a block diagram showing the construction of the controller 1. As shown in FIG. 2, the controller 1 includes a communication unit 11, a control unit 12, an HDD 13, a RAM 14, an operation unit 15, and a display unit 16. The communication unit 11, HDD 13, RAM 14, operation unit 15, and display unit 16 are connected to the control unit 12.

The communication unit 11 is a circuit unit that communicates with the performance terminals 2, and has a USB interface (not shown). The MIDI interface box 3 is connected to the USB interface. The communication unit 11 communicates with the six performance terminals 2 via the MIDI interface box 3 and MIDI cables. The HDD 13 stores an operating program for the controller 1 and music data for performance consisting of a plurality of parts.

The control unit 12 reads out the operating program stored in the HDD 13, develops it in the RAM 14 as a work memory, and executes apart assignment process 50, a sequence process 51, a sounding instruction process 52, etc. In the part assignment process 50, the control unit 12 assigns the performance parts of music data for performance to respective ones of the performance terminals 2. In the sequence process 51, the control unit 12 sequences each performance part of the music data for performance (determines the pitch, length, etc. of each sound) according to the instructions on tempo and timing received from the corresponding performance terminal 2. In the sounding instruction process 52, the control unit 12 transmits, as sounding instruction data, the pitch, length, etc. of each sound determined in the sequence process 51 to the corresponding performance terminal 2.

The operation unit 15 is used by some user (mainly by the facilitator) to give instructions on operations of the present performance system. The facilitator operates the operation unit 15, whereby music data for performance is designated, and performance parts for respective performance terminals 2 are assigned, and so on. The display unit 16 includes a display (monitor). The facilitator and the participants conduct performance operations while watching the display unit 16 on which various information for an ensemble performance are displayed, as will be described in detail below.

Figure 3:
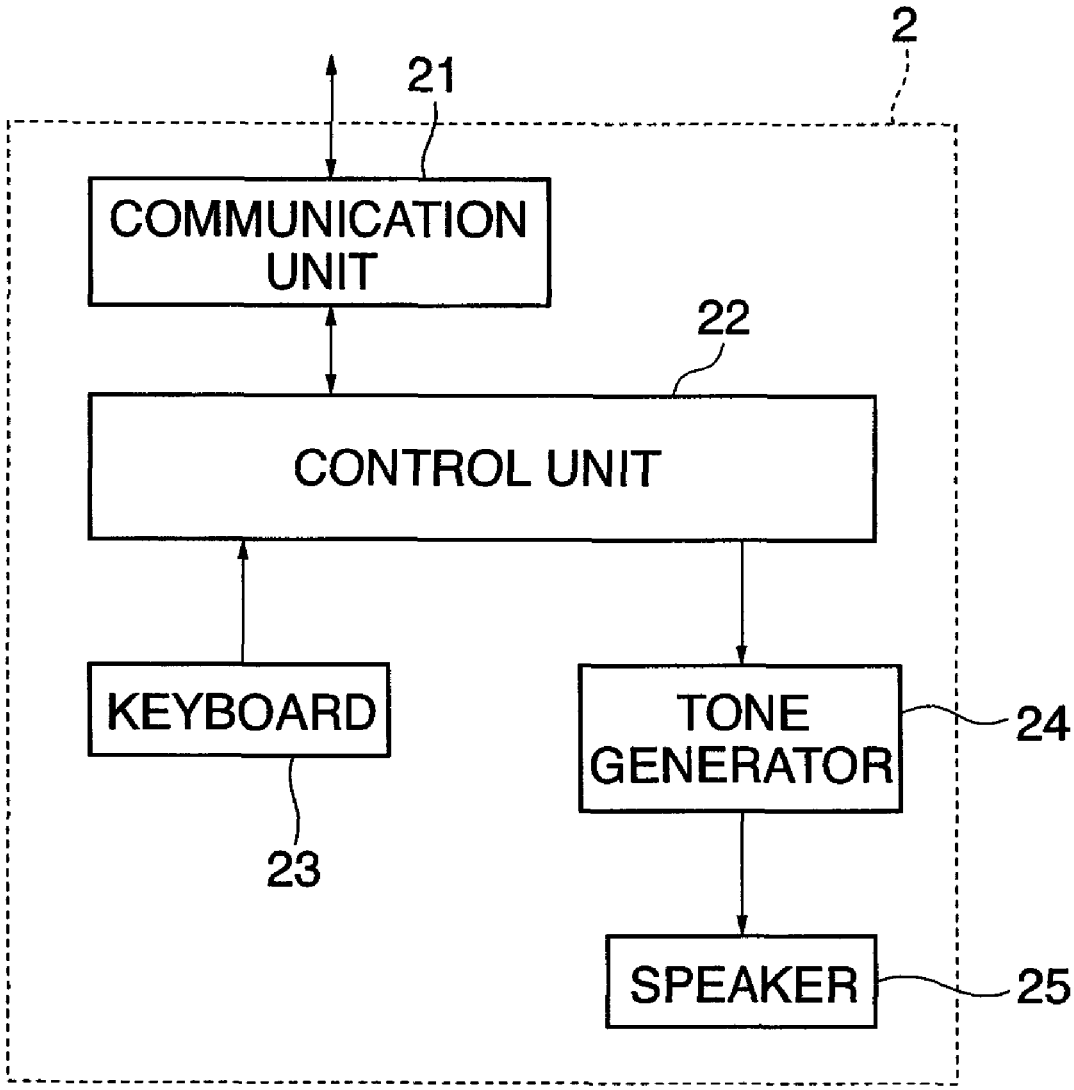
FIG. 3 is a block diagram showing the construction of a performance terminal.

FIG. 3 is a block diagram showing the construction of the performance terminal 2. As shown in FIG. 3, the performance terminal 2 includes a communication unit 21, a control unit 22, a keyboard 23 as a performance operator unit, a tone generator 24, and a speaker 25. The communication unit 21, keyboard 23, and tone generator 24 are connected to the control unit 22. The speaker 25 is connected to the tone generator 24.

The communication unit 21 is a MIDI interface and communicates with the controller 1 via a MIDI cable. The control unit 22 centrally controls the performance terminal 2. The keyboard 23 has, for example, 61 or 88 keys and can play in 5 to 7 octaves. The present ensemble system only uses data about Note On/Note Off messages and key depression intensity (Velocity), without distinction between keys. To this end, each key includes a sensor for detecting on/off and a sensor for detecting the intensity of key depression. The keyboard 23 outputs an operation signal to the controller 22 according to a key operation state (e.g., which key is depressed at what intensity). The control unit 22 transmits a Note On or Note Off message to the controller 1 via the communication unit 21 based on the input operation signal. The tone generator 24 generates a sound waveform under the control of the control unit 22 and outputs it as an audio signal to the speaker 25. The speaker 25 reproduces the audio signal input from the tone generator 24 to produce music sound. As described above, the tone generator 24 and the speaker 25 may not be incorporated in the performance terminal 2. The tone generator and the speaker may be connected to the controller 1 so that music sounds are sounded from a place different from where the performance terminal 2 is located. While as many tone generators as the performance terminals 2 may be connected to the controller 1, a single tone generator may be used.

In the above-described operation, when a key of the keyboard 23 is depressed, the control unit 22 transmits a Note On/Note Off message to the controller 1 (Local Off) and produces music sound according to an instruction from the controller 1 rather than according to a note message from the keyboard 23. Aside from the above described operations, the performance terminal 2 may be used as a general electronic musical instrument. When a key of the keyboard 23 is depressed, the control unit 22 may not transmit a note message to the controller 1 (Local On), but instruct the tone generator 24 to produce music sound based on the note message. Switching between Local On and Local Off may be performed by the user using the operation unit 15 of the controller 1 or using a terminal operation unit (not shown) on the performance terminal 2. It is also possible to set only some keyboards to Local Off and the other keyboards to Local On.

Figure 4:
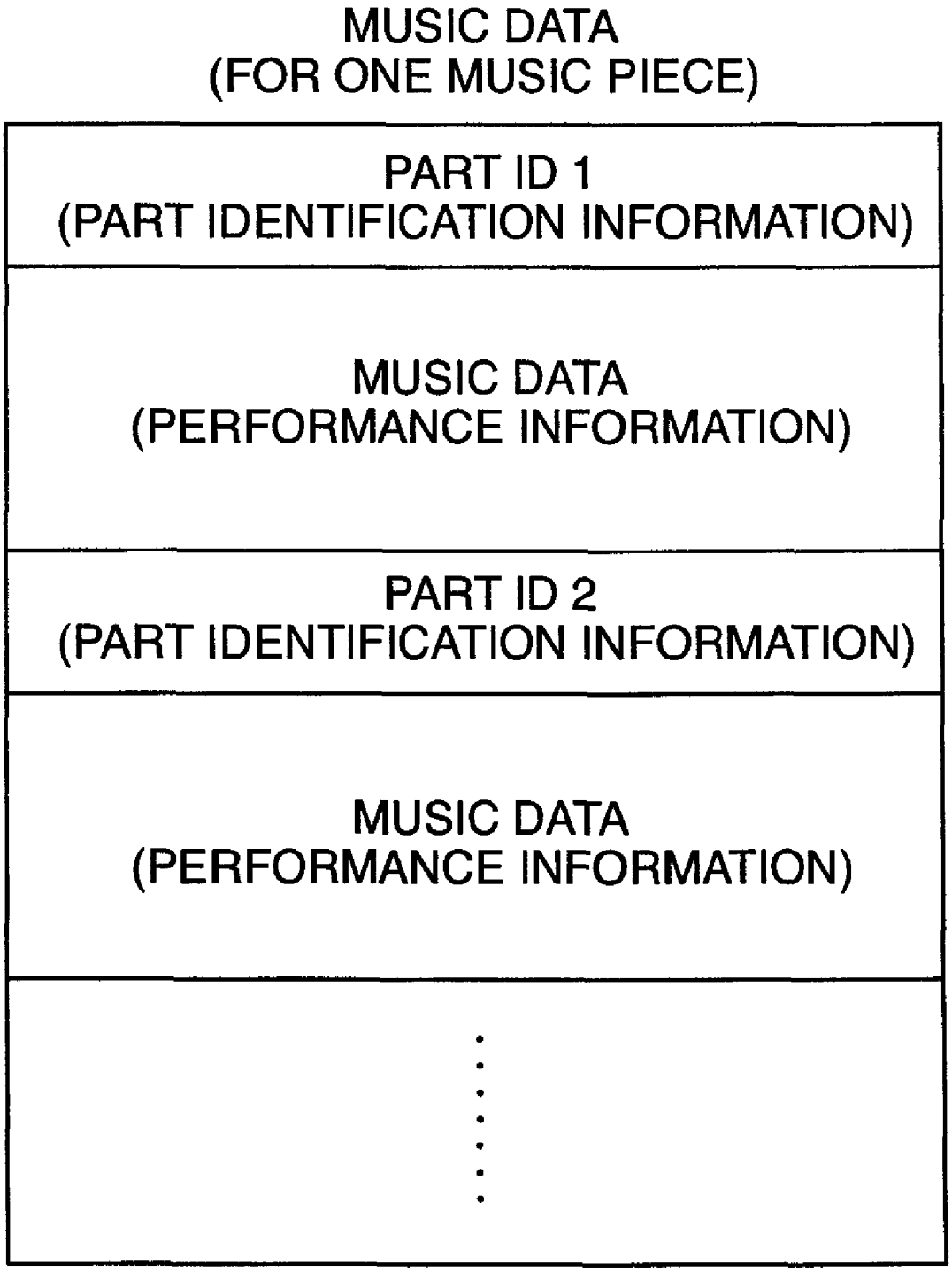
FIG. 4 is a view showing an example of music data.

The following is an explanation of operations for implementing an ensemble performance using the above described ensemble system. Some user (in particular, the facilitator) selects music data for performance using the operation unit 15 of the controller 1. The music data for performance is data (standard MIDI) prepared in advance based on the MIDI standard and stored in the HDD 13 of the controller 1. An example of such music data is shown in FIG. 4. As shown in FIG. 4, the music data includes a plurality of performance parts, and includes pieces of identification information that identify respective ones of the performance parts, and pieces of performance information about the performance parts.

When music data for performance is selected by some user, the controller 1 assigns performance parts to respective ones of the performance terminals 2 connected thereto. Which performance part should be assigned to which performance terminal is specified beforehand in a table. FIG. 5 is a view showing an example of the performance part assignment table. As shown in FIG. 5, MIDI port 0 (performance terminal for facilitator) corresponds to performance part 1. The performance part 1 is assigned to, for example, the performance terminal 2A in FIG. 1. Each MIDI port represents a port number in the MIDI interface box 3. Each performance terminal 2 is identified by the MIDI port to which it is connected. MIDI port 1 (piano 1) corresponds to performance part 2, which is assigned to, for example, the performance terminal 2B in FIG. 1. Ditto for the others. In this manner, the performance parts are automatically assigned to respective ones of the performance terminals 2. The performance part assignment table is registered beforehand in the HDD 13 of the controller 1 by the facilitator. Alternatively, the facilitator can make a manual selection using the operation unit 15 of the controller 1.

If the performance terminals 2 are connected to USB ports, the performance terminals 2 may be identified by USB port numbers.

A performance-start standby instruction is input by the facilitator via the operation unit 15 of the controller 1 after the music data for performance is selected by the facilitator and the performance parts are assigned by the controller 1 to respective ones of the performance terminals 2. The term "performance-start standby" does not indicate that music sound is actually produced, but indicates that the controller 1 reads out the music data for performance from the HDD 13 to the RAM 14 to thereby prepare for performance operation.

When the performance-start standby instruction is input to the operation unit 15 and the preparation for performance is completed by the controller 1, the performance terminals 2 are made ready for performance. With the present ensemble system, performance operations are implemented by a plurality of users in time with the facilitator's (ensemble leader's) performance. Since the users do not conduct performances in time with an exemplar performance (mechanic demonstrative performance), but in time with the facilitator's performance (human performance), they can have a sense of actually participating in an ensemble performance.

The following is an explanation of operations of the ensemble system during an ensemble performance. When the operator unit (keyboard) 23 of any of the performance terminals 2 is depressed by the user with a finger, the controller 22 transmits a Note On message to the controller 1 according to the intensity of key depression. The Note On message contains information representing the key depression intensity (Velocity), etc. When the keyboard 23 is released (the finger is lifted), the controller 22 transmits a Note Off message to the controller 1. Based on the Note On and Note Off messages received from the performance terminal 2, the controller 1 determines the pitch, length, etc. of each sound in the music data for performance of a predetermined length (e.g., for one beat) among the performance part assigned to the performance terminal 2, and transmits music data for performance having the determined pitch, length, etc. to the performance terminal 2, as sounding instruction data. The sounding instruction data includes sounding timing, length, intensity, tone color, effect, pitch change (pitch bend), tempo, and so on.

Based on a time period from when the Note On message has been received to when the Note Off message has been received, the controller 1 determines the sounding instruction data. Specifically, when the Note On message is input, the controller 1 reads out the corresponding performance part of the predetermined length (e.g., for one beat) among the music data for performance, and determines the sounding timing, tone color, effect, pitch change, etc. Further, the controller 1 determines the sounding intensity in accordance with the Velocity information in the Note On message. The performance information in the music data for performance contains information indicating the sound volume, but the sounding intensity is determined by multiplying the sound volume by the Velocity information. Specifically, although the music data for performance already includes sound volume information taking account of a volume representation (sound dynamics) for the music, a dynamics representation that varies depending on the user's key depression intensity is added, whereby the sounding intensity is determined.

When the Note Off message is input, the controller 1 times a time period from the reception of the Note On message to the reception of the Note Off message. Music sound sounded first is continued to be produced until the Note Off message is input. When the Note Off message is input, the tempo in the concerned beats and the length of each music sound are determined, and the next music sound is sounded.

Although the tempo may simply be determined based on the time period from the Note On to the Note Off (referred to as the Gate Time), the tempo can be determined as follows. The moving average of the Gate Time is calculated for a plurality of key depressions (immediately preceding key depressions) and weighted by time. The weight is the heaviest on the last key depression. The earlier the key depression is, the lighter the weight thereon is. By determining the tempo in this manner, a sudden tempo change can be prevented, even if one key depression causes a significant change in the Gate Time. Therefore, the tempo can smoothly be changed according to the flow of the music, without causing uncomfortable feeling.

In the performance terminal 2, the controller 22 receives the sounding instruction data determined as described above by the controller 1, and instructs the tone generator 24 to generate a sound waveform. The tone generator 24 generates a sound waveform and reproduces music sounds from the speaker 25. The above described processing is repeated every time each user depresses the keyboard 23. Thus, music performance can be made by depressing the keyboard 23, for example, on every beat.

As described above, the music sound sounded first is continued to be produced until a Note Off message is input. Therefore, the same music sound is kept produced until the user lifts his finger from the keyboard 23, whereby a sustained-sound representation (fermata) can be realized in the ensemble system.

It is also possible to realize the following performance representation by determining the tempo, as described above, based on the moving average of the Gate Time. For example, when a key depression is performed shortly on the keyboard 23, the length of each sound for the corresponding beats is made short, whereas when the keyboard 23 is depressed for a long duration, the length of each sound for the corresponding beats is made long. As a result, the performance representation of crisp sounds (staccato) without a significant change in the tempo can be realized, and the performance representation of sustained sounds (tenuto) without a significant change in the tempo can also be realized.

In this embodiment, the Note On and Note Off messages are transmitted to the controller 1 irrespective of which keyboard 23 of the performance terminals 2A to 2F is depressed. Alternatively, the keyboards 23 may be divided into those that enable the staccato and tenuto and those that do not. The controller 1 may change the length of sound while maintaining the tempo only when the Note On and Note Off messages are input from specific keyboards (e.g., E3).

Figure 6:
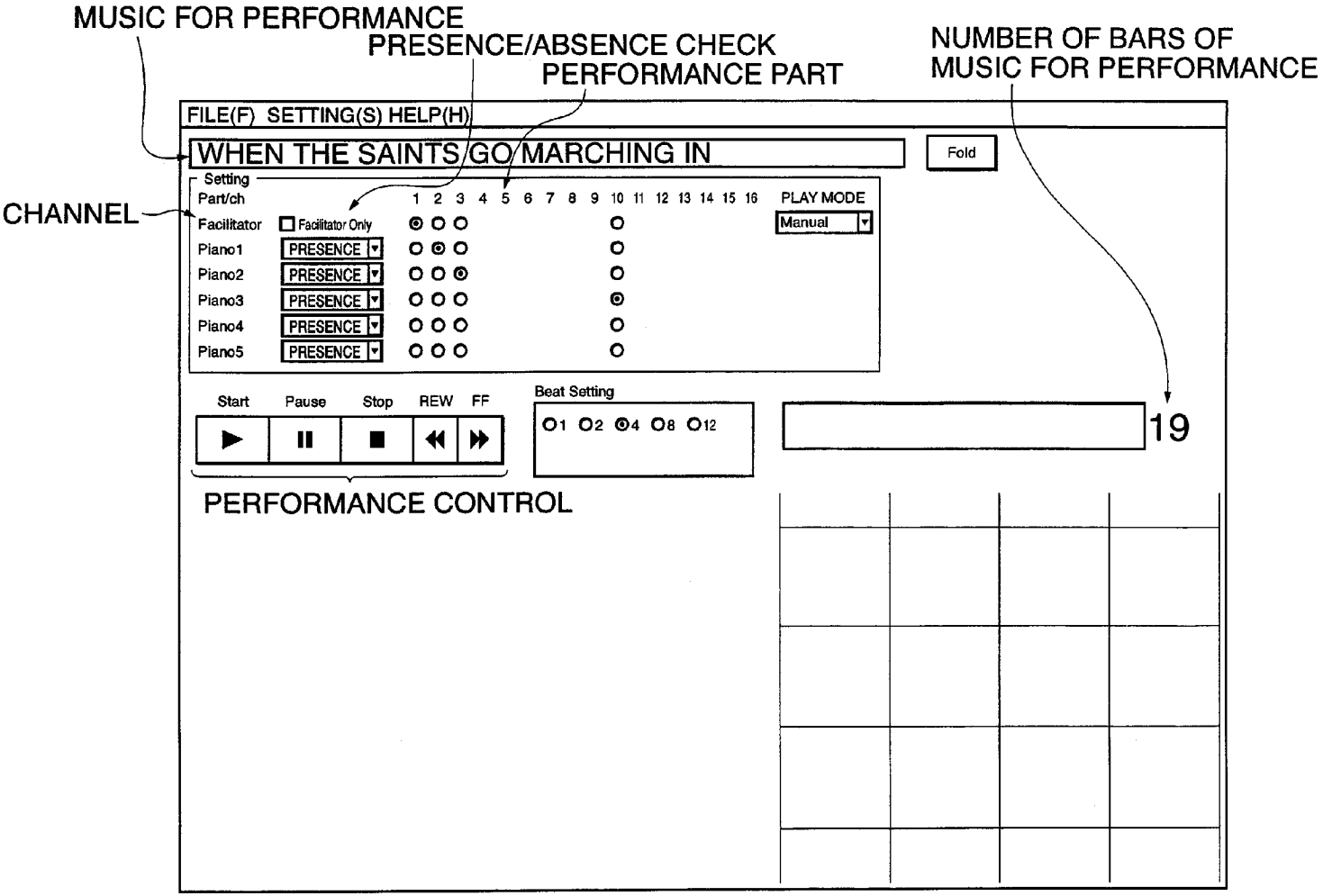
FIG. 6 is a view showing a main operation window.

Next, an explanation will be given of a user interface shown on the display unit 16. Referring to FIG. 6, a main operation window is displayed on the display unit 16. In a text field in an upper part of this window, the name of music data for being performed, which is selected by the user, is shown. In a "Setting" field, the performance terminals (Facilitator and Pianos 1 to 5) are indicated. For each of the performance terminals, a pull-down menu for selection of presence/absence and radio buttons for performance part assignment are shown. The performance terminals (Facilitator and Piano 1 to 5) are associated with MIDI ports of the MIDI interface box 3.

The selective input to the presence/absence pull-down menus is performed by the facilitator according to the presence or absence of the educands. The radio buttons are shown only for performance terminals to which performance parts of the music data for performance are respectively assigned.

In the example shown in FIG. 6, performance parts 1, 2, 3, and 10 are set for the selected music data for performance. When this music data for performance is selected, the performance terminals "Facilitator", "Piano 1", "Piano 2" and "Piano 3" are automatically assigned to respective ones of the performance parts 1, 2, 3, and 10. In FIG. 6, the selected music data for performance includes only four performance parts, and therefore, these performance parts are assigned only to the performance terminals "Facilitator" and "Pianos 1 to 3". On the other hand, in the case, for example, that the music data for performance includes six performance parts, these performance parts are respectively assigned to the performance terminals "Facilitator" and "Pianos 1 to 5". In the case that there are performance parts greater in number than the MIDI ports (performance terminals), more than one performance parts are assigned to the performance terminal "Facilitator". The user (facilitator) operating the controller 1 can manually select, by the radio button selection, respective performance parts for desired performance terminals. When a checkbox "Facilitator Only" is selected, all the performance parts are assigned to the performance terminal "Facilitator". No radio button is displayed for performance terminals 2 set as "absent" on the pull-down menus, so that no performance part is assigned to these performance terminals 2.

In the case that the performance part assignment is automatically implemented based on the table shown in FIG. 5, if there is a performance terminal for which the "absence" is selected on the presence/absence pull-down menu, a performance part scheduled to be assigned to the absent performance terminal is assigned to the performance terminal "Facilitator". In that case, the performance part for the "absent" performance terminal may be assigned to another performance terminal, instead of a performance part scheduled to be assigned to the other performance terminal and close in tone color or role to the performance part for the absent performance terminal (for example, the part scheduled to be assigned to the absent terminal is a drums part, and the part scheduled to be assigned to the other terminal is a base part, string instrument part, or the like). The relation between relevant performance parts may be specified in advance in the table.

Figure 7:
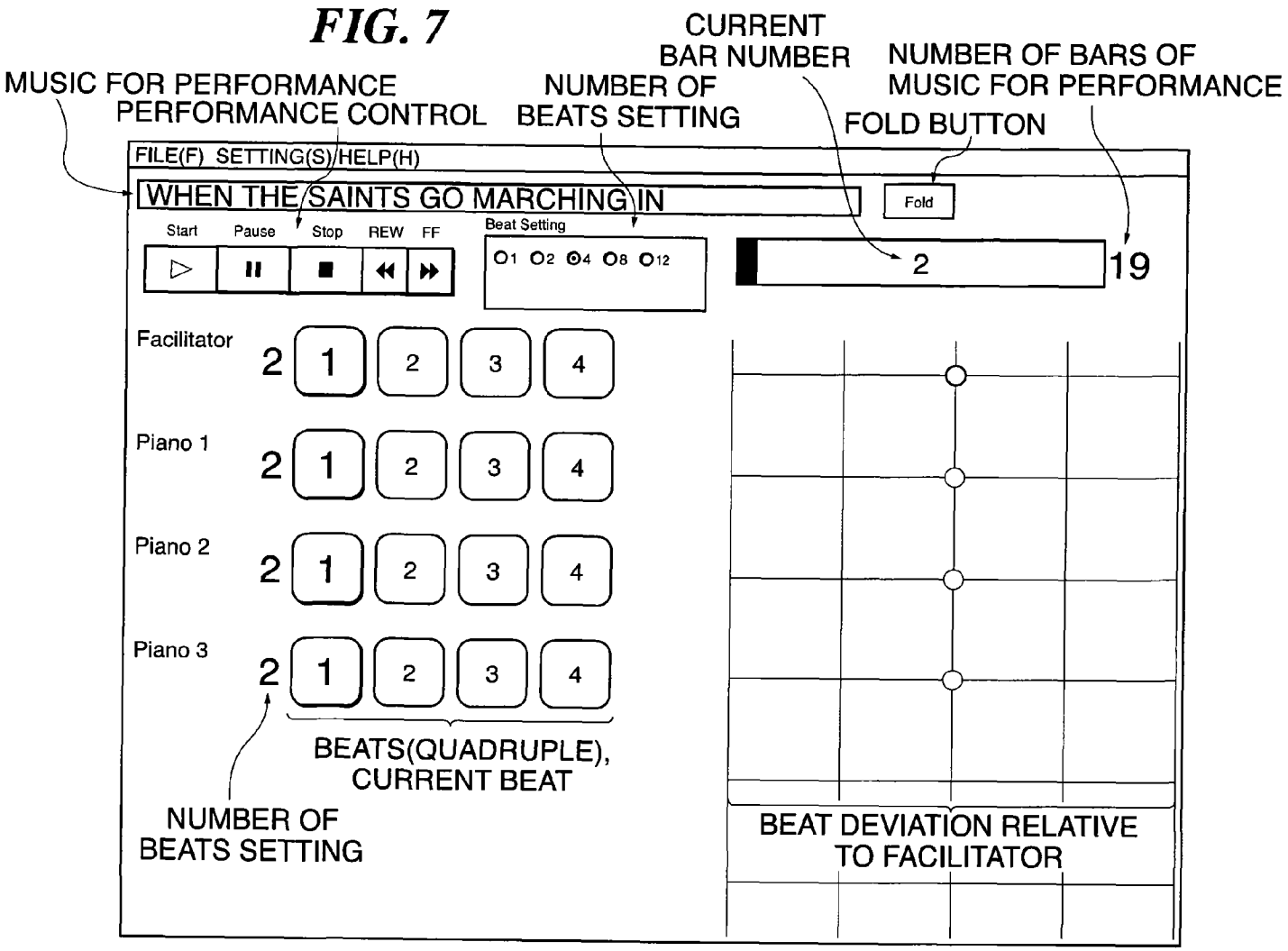
FIG. 7 is a view showing an ensemble window.
Figure 8A:
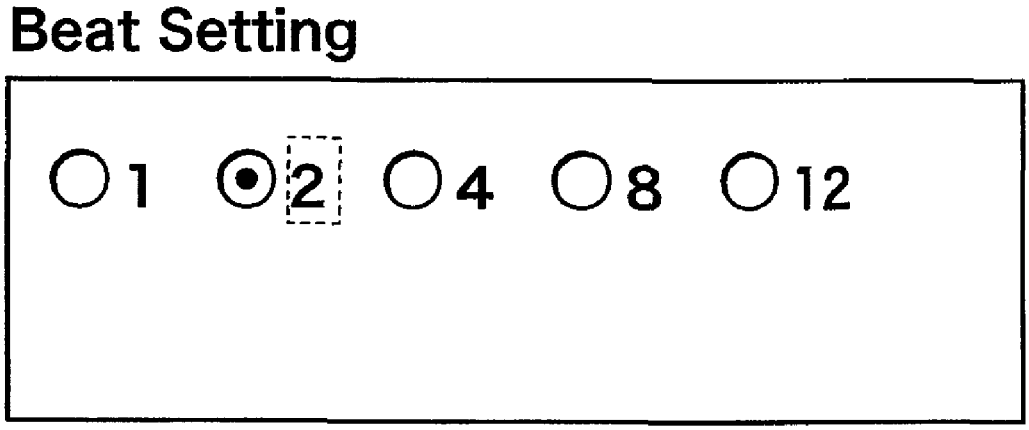
FIG. 8A is a view showing the setting of the number of beats.

When a Start button among performance control buttons displayed on the left side of the middle of the window is depressed after execution of the performance part assignment, performance-start standby is achieved, and an ensemble window shown in FIG. 7 is displayed on the display unit 16. Also in this window, the name of the selected music data for performance is displayed in an upper text field. On the upper right side of the window, there are displayed the number of bars included in the selected music data for performance and the current bar number at which the performance is currently performed. In a number of beats field (Beat Setting) displayed on an upper part of the middle of the window, radio buttons for setting the number of beats in one bar are shown. In FIG. 7, the number of beats is set to four, and the music data is performed at four-four time (four beats per bar). In that case, a key depression will be made on every beat. When a two-beat button is selected for the music being performed as shown in FIG. 8A, a key depression will be made on every other beat, and the first and third beats will be the key depression timing. In that case, in response to the transmission of Note On and Note Off messages from the performance terminal 2, the controller 1 returns sounding instruction data of the length of two beats. That is, the performance will be performed for the length of two beats in response to one key depression.

Figure 8B:
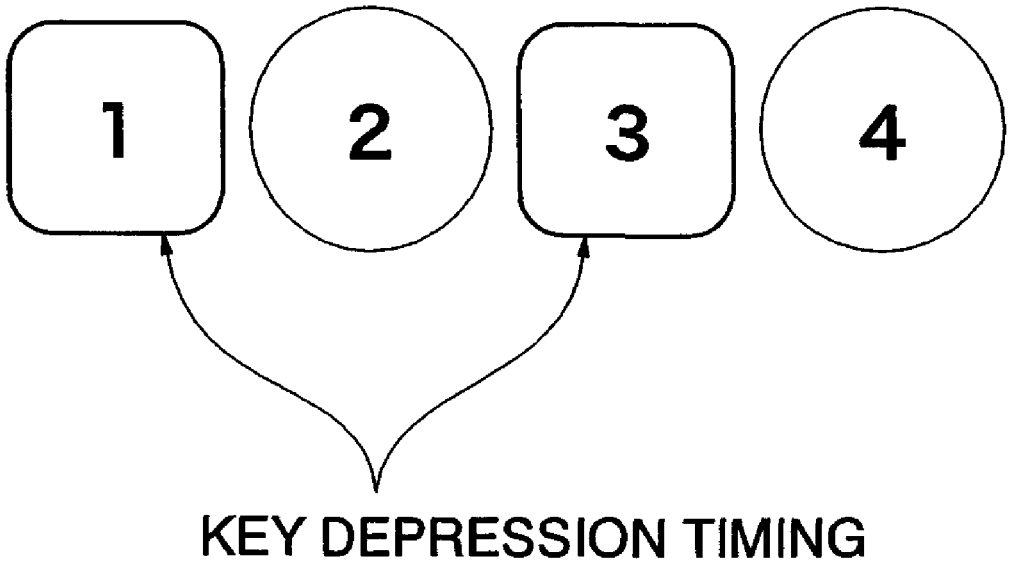
FIG. 8B is a view showing an example of icon representations of beats (first and third beats) corresponding to key depression timing and beats (second and fourth beats) not corresponding to key depression timing.

Referring to FIG. 7, the current bar number, the number of beats in the bar (the number of times the key depression should be made in the bar), and the current beat (current key depression timing) for each of the performance terminals (Facilitator, Piano 1, Piano 2, and Piano 3) are displayed on the left side of the middle of the ensemble window. As shown in FIG. 7, the number of times the key depression should be made is represented by rectangular icons each having a numeral therein, and the current beat is represented by a three-dimensional rectangular icon or a bold icon. The way of representation is not limited to using these icons described in this example, but differently shaped icons may be used. As shown in FIG. 8B, the beats deviated from key depression timing (i.e., the second and fourth beats) are each indicated by a differently shaped icon such as a circular icon having a numeral therein.

Figure 9:
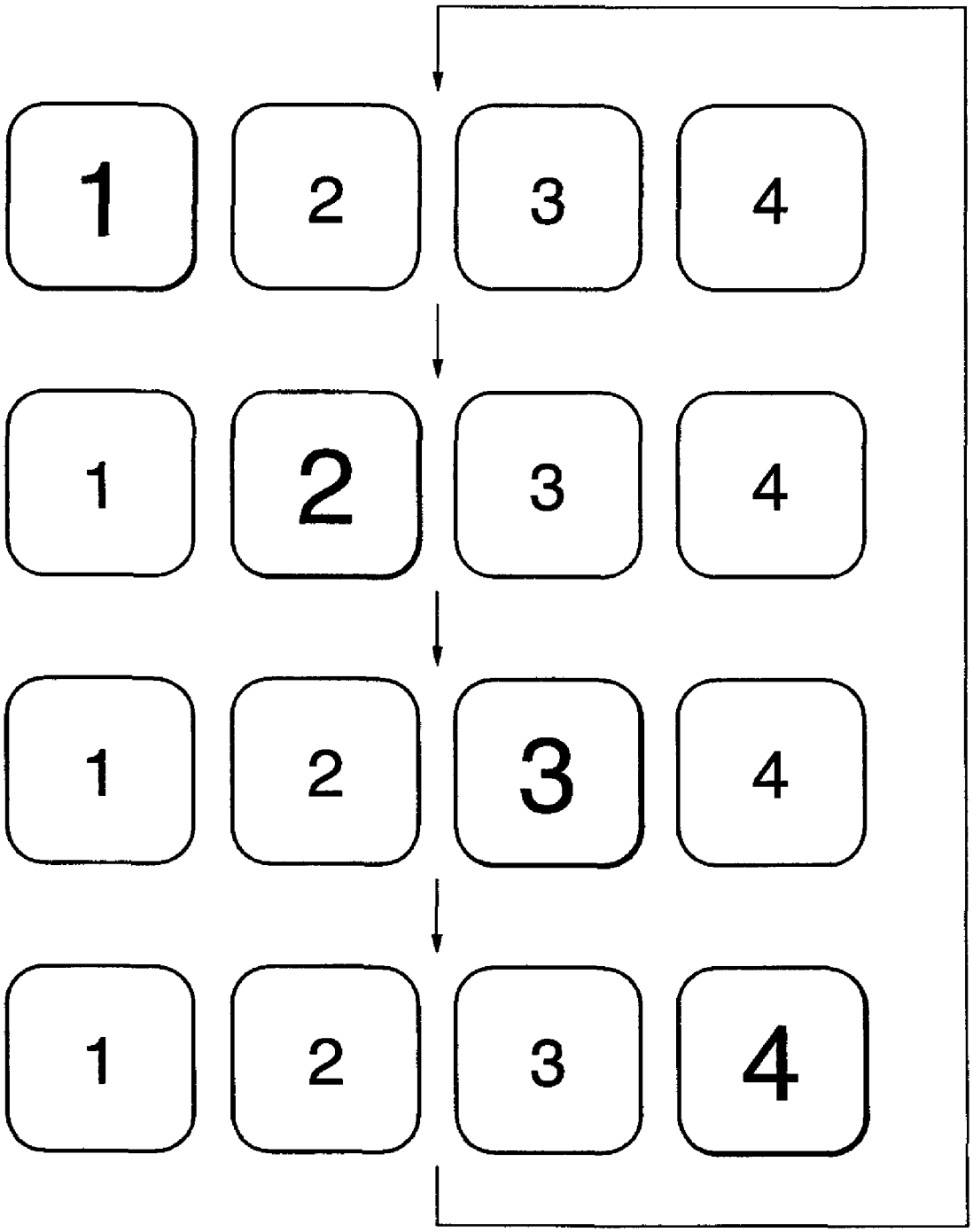
FIG. 9 is a view showing a shift of current beat.

Upon each key depression by the user, the current beat shifts one by one as shown in FIG. 9. Specifically, the beat represented by the three-dimensional rectangular icon or the bold icon shifts between the first, second, third, and fourth beats in this order on every key depression. In this example, the music data of four-four time is used for performance, and therefore, subsequently to the key depression on the fourth beat, the current beat is returned to the first beat, whereby the music data is advanced by one bar.

Referring to FIG. 7, a field for indicating a beat deviation relative to the beat of the performance terminal "Facilitator" is displayed on the right side of the middle of the window. In this field, a plurality of (for example, five) vertical lines are shown, and lateral lines are shown such as to correspond to respective ones of the performance terminals. In addition, there are shown circular marks respectively corresponding to these performance terminals. Each circular mark indicates a deviation relative to the performance terminal "Facilitator".

Figure 10:
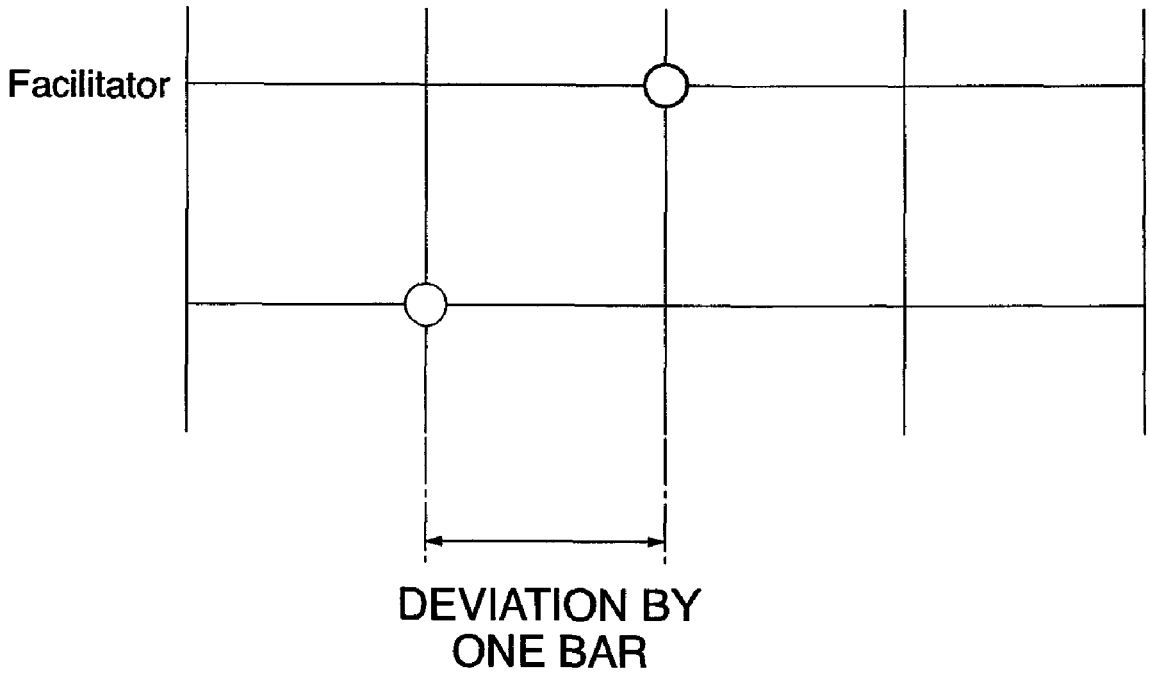
FIG. 10 is a view for explaining a beat deviation relative to a performance terminal "Facilitator"

FIG. 10 is a view for explaining a beat deviation relative to the performance terminal "Facilitator". As shown in FIG. 10, the circular mark corresponding to the performance terminal "Facilitator" is fixedly shown on the center line among the vertical lines, and each of the circular marks respectively corresponding to user's performance terminals (for example, the circular mark corresponding to "Piano 1") is moved to the left and the right according to the beat deviation relative to the performance terminal "Facilitator". For example, when the key depression is lag behind the key depression on the performance terminal "Facilitator" by one bar (four beats in this example), the circular mark is moved leftward by one vertical line as shown in FIG. 10. If there is a delay of one-half bar (two beats), the circular mark is moved leftward from the center vertical line by a distance equal to half an interline distance. On the other hand, if the key depression leads the key depression on the performance terminal "Facilitator", the circular mark is moved rightward. In FIG. 100, there are displayed two lines with respect to the center line on each side, left and right, and therefore, a beat deviation of up to two bars can be displayed. If there occurs a beat deviation of more than two bars, the icon is changed (into, for example, a rectangular icon) at the left or right end of the line. As a result, each user can easily recognize a deviation of performance (beat) from that of the facilitator.

It should be noted that a reference performance terminal is not limited to the performance terminal "Facilitator". An amount of beat deviation may be displayed with reference to any of the performance terminals 2.

The field for indicating the beat deviation relative to the performance terminal "Facilitator" is not limited to the above described example where it is displayed on the display unit 16 of the controller 1, but can be displayed on a display unit (not shown) for performance terminal, which is provided in each of the performance terminals 2.

As described above, each user can implement the performance by performing simple operations such as depressing the keyboard with a finger, and an ensemble performance can be carried out by the users, while enjoying themselves, by making operations in such a way as to reduce a deviation of performance (beat) from that of the performance terminal "Facilitator", the deviation being displayed on the display unit 16.

Furthermore, with this ensemble system, the controller 1 automatically records the presence or absence, the number of times of key depression, the key depression intensity, the amount of deviation, etc. with respect to each user in the HDD 13 upon completion of performance of each music piece. Thus, the facilitator can easily perform presence/absence management on the group concerned by referring to the recorded history, making it possible to easily manage the degree of progress of respective users on a daily, weekly, or monthly basis. In the following, a performance history record will be explained.

FIG. 11 is a view showing an example of a performance history. The controller 1 records a value in each of items in the performance history shown in FIG. 11 according to performance operations on the respective performance terminals 2, and outputs a record, which is text data, in a file format such as a CSV (Comma Separated Values) format after completion of a performance. The recorded performance history can be displayed using spreadsheet software or the like. When the Start button among the performance control buttons in FIG. 6 is depressed by the facilitator whereby a performance-start instruction is given, the recording for respective items is started. The items are recorded for each music being performed. The date, day of week, and time at which the facilitator depresses the Start button to give the performance-start instruction are recorded in items of date, day of week, and time. When the performance-start instruction is given by the facilitator, a value of 1 is recorded in presence/absence items corresponding to MIDI ports for which "presence" has been selected on the "presence/absence" pull-down menu, whereas a value of 0 is recorded in presence/absence items corresponding to MIDI ports for which "absence" has been selected. If a value of "1" is displayed in an item "presence/absence (Fa)" in the performance history in FIG. 11, it is indicated that the performance terminal "Facilitator" participates in the music performance. Similarly, if a value of "1" is displayed in an item "presence/absence (P1)", it is indicated that the performance terminal "Piano 1" participates in the music performance. On the other hand, if a value of "0" is displayed, it is indicated that the terminal concerned does not participate in the performance and is absent.

The controller 1 counts a key depression (Note On message input) on each performance terminal 2 from when the Start button is depressed to when the Stop button is depressed or to when the performance of a music piece is completed, whereupon aggregation is implemented. An item "Keyon(Fa)" in the performance history in FIG. 11 is for indicating the total number of times of key depression on the performance terminal "Facilitator" in the music performance. Similarly, an item "Keyon(P1)" is for indicating the total number of times of key depression on the performance terminal "Piano 1" in the music performed.

Furthermore, the controller 1 records a Velocity value input from each performance terminal 2 from when the Start button is depressed to when the Stop button is depressed or to when the performance of the music piece is completed, and calculates an average Velocity value in the music piece using the total number of times of key depression. An item "Average V(Fa)" in the performance history in FIG. 11 is for indicating an average Velocity value for the performance terminal "Facilitator" in the music performed.

Further, the controller 1 records a deviation in key depression timing between each performance terminal and the performance terminal "Facilitator" from when the Start button is depressed to when the Stop button is depressed or to when the performance of the music piece is completed, and calculates an average value thereof using the total number of times of key depression. The controller 1 calculates a time difference, for the same beat in the same bar, between when a key depression is performed on the performance terminal "Facilitator" and when a key depression is performed on a performance terminal from which a Note On message is currently input, and records the calculated time difference as a deviation relative to the performance terminal "Facilitator", whereupon aggregation is implemented. An item "Average deviation (P1)" in the performance history in FIG. 11 is for indicating a deviation in average key depression timing between the performance terminal "Piano 1" and the performance terminal "Facilitator" in the music performed. The smaller the deviation value, the smaller the deviation of key depression timing in the music performance relative to the performance terminal "Facilitator" will be, which indicates that the performance has successfully been performed.

As described above, a state of attendance of respective performance terminals 2 to the performance, the number of times of key depression, the key depression intensity, the amount of deviation, etc. are recorded and stored for each music piece. Thus, the facilitator can grasp a state of participants at a glance.

Figure 12:
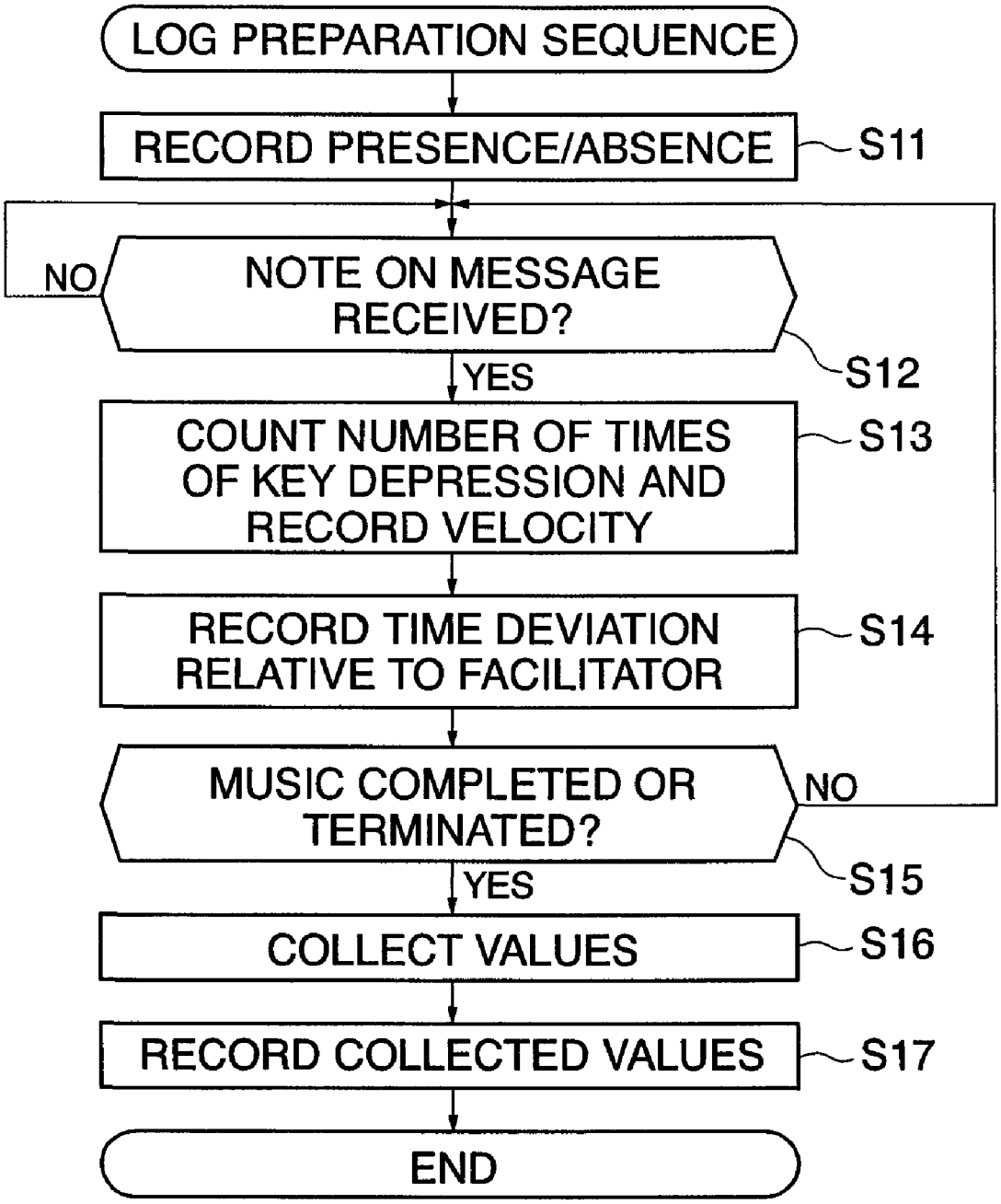
FIG. 12 is a flowchart showing a log preparation sequence.

Next, a detailed explanation will be given of the operation of the controller 1 for recording the performance history. FIG. 12 is a flowchart showing a log preparation sequence of the controller 1. This sequence is triggered by the facilitator by giving the performance-start instruction using the operation unit 15 (by depressing the Start button among the performance control buttons). This sequence is executed by the control unit 12 of the controller 1.

First, a value of 1 is set to the presence/absence items for MIDI ports for which "presence" has been selected, whereas a value of 0 is set to the presence/absence items for MIDI ports for which "absence" has been selected, whereupon these are temporarily recorded in the RAM 14 (s11). Subsequently, whether or not a Note On message is received is determined (s12). This determination is repeatedly executed until a Note On message is received. If a Note On message is received from any of performance terminals, the number of times of key depression on the performance terminal 2 is counted, and an input Velocity value is temporarily recorded in the RAM 14 (s13). A time deviation relative to the performance terminal "Facilitator" is also temporarily recorded in the RAM 14 (s14). To this end, a time difference, for the same beat in the same bar, between when a key depression is performed on the performance terminal "Facilitator" and when a key depression is performed on a performance terminal from which a Note On message is currently input is calculated, and the calculated time difference is temporarily recorded in the RAM 14 as a deviation relative to the performance terminal "Facilitator".

Subsequently, whether or not the music data being performed has been reproduced to its end so that the music performance has been completed or whether or not the Stop button among the performance control buttons has been depressed by the facilitator to input a performance-termination instruction is determined (s15). If the performance has not been completed or terminated, the process starting from the determination as to whether or not a Note On message has been received is repeated (from s15 to s12). If the performance has been completed or terminated, values for respective items temporarily recorded in the RAM 14 are collected (s16). The total number of times of key depression in the music piece is collected, and an average Velocity value is calculated using the calculated total number of times of key depression. An amount of deviation relative to the performance terminal "Facilitator" is also calculated. Finally, these collected values are recorded in the HDD 13 in the form of text data (s17).

As described above, participants' logs are recorded, whereby the facilitator can easily perform presence/absence management by simply specifying the start and end of performance. Further, the degree of progress of respective participants can easily be managed on a daily, weekly, or monthly basis. For example, if some participant has been frequently absent, there is a high possibility that such participant feels that the lesson is too hard. Such is useful information in planning a wellness activity program. By referring to the logs, participants can grasp the degree of progress and are encouraged to participate in ensemble performance. Furthermore, comparison or competition between groups can be achieved, whereby participants are provided with a motivation to engage in practice or wellness activity.

INDUSTRIAL APPLICABILITY

With this invention, the presence/absence management on participants can easily be performed, and the degree of progress can easily be managed on a daily, weekly, or monthly basis. Further, comparison between participants or between groups, etc. can be made, whereby a motivation to participate in ensemble performance can be provided.

The invention claimed is:

1. An ensemble system comprising:

a plurality of performance terminals each having at least one performance operator unit used for performance operation;

at least one tone generator; and a controller connected to the plurality of performance terminals and the at least one tone generator and adapted to control each of the performance terminals, wherein the controller includes:

storage means adapted to store music data for performance, the music data including a plurality of performance parts;

performance control means adapted to assign the plurality of performance parts to respective ones of the plurality of performance terminals prior to performance, read out a performance of the performance part assigned to each of the performance terminals in accordance with a way in which the performance operator unit of said each of said performance terminals is operated, and output data representing the read-out performance(s) to the tone generator(s); and record means adapted to record whether each of the performance terminals participated in performance of the music data and record a performance history for each of the performance terminals from start to completion of the performance of the music data, wherein the performance history includes information representing a number of times of and an average intensity of performance operation.

2. The ensemble system according to claim 1, wherein the performance history includes information representing an average deviation relative to the performance operation on a guide performance terminal among the performance terminal.

3. An ensemble system comprising:

a plurality of performance terminals each having at least one performance operator unit used for performance operation;

at least one tone generator; and a controller connected to the plurality of performance terminals and the at least one tone generator and adapted to control each of the performance terminals, wherein the controller includes:

storage means adapted to store music data for performance, the music data including a plurality of performance parts;

performance control means adapted to assign the plurality of performance parts to respective ones of the plurality of performance terminals prior to performance, read out a performance of the performance part assigned to each of the performance terminals in accordance with a way in which the performance operator unit of said each of said performance terminals is operated, and output data representing the read-out performance(s) to the tone generator(s); and record means adapted to record whether each of the performance terminals participated in performance of the music data and record a performance history for each of the performance terminals from start to completion of the performance of the music data, wherein the ensemble system further comprises a plurality of the tone generators, wherein one of the tone generators is built in each of the plurality of performance terminals, wherein said performance control means of the controller is adapted to output information on the read-out performance part to the tone generator built in the performance terminal to which the performance part is assigned, and wherein the performance history includes information representing a number of times of and an average intensity of performance operation.

4. An ensemble system comprising:

a plurality of performance terminals each having at least one performance operator unit used for performance operation;

at least one tone generator; and a controller connected to the plurality of performance terminals and the at least one tone generator and adapted to control each of the performance terminals, wherein the controller includes:

a storage unit adapted to store music data for performance, the music data including a plurality of performance parts;

a performance control unit adapted to assign the plurality of performance parts to respective ones of the plurality of performance terminals prior to performance, read out a performance of the performance part assigned to each of the performance terminals in accordance with a way in which the performance operator unit of said each of said performance terminals is operated, and output data representing the read-out performance(s) to the tone generator(s); and a record unit adapted to record whether each of the performance terminals participated in performance of the music data and record a performance history for each of the performance terminals from start to completion of the performance of the music data, wherein the performance history includes information representing a number of times of and an average intensity of performance operation.

5. An ensemble system comprising:

a plurality of performance terminals each haying at least one performance operator unit used for performance operation;

at least one tone generator; and a controller connected to the plurality of performance terminals and the at least one tone generator and adapted to control each of the performance terminals, wherein the controller includes:

a storage unit adapted to store music data for performance, the music data including a plurality of performance parts;

a performance control unit adapted to assign the plurality of performance parts to respective ones of the plurality of performance terminals prior to performance, read out a performance of the performance part assigned to each of the performance terminals in accordance with a way in which the performance operator unit of said each of said performance terminals is operated, and output data representing the read-out performance(s) to the tone generator(s); and a record unit adapted to record whether each of the performance terminals participated in performance of the music data and record a performance history for each of the performance terminals from start to completion of the performance of the music data, wherein the ensemble system further comprises a plurality of the tone generators, wherein one of the tone generators is built in each of the plurality of performance terminals, wherein said performance control unit of the controller is adapted to output information on the read-out performance part to the tone generator built in the performance terminal to which the performance part is assigned, and wherein the performance history includes information representing a number of times of and an average intensity of performance operation.

6. An ensemble method implemented by a controller in an ensemble system, the ensemble system comprising a plurality of performance terminals each having at least one performance operator unit used for performance operation, the ensemble system further comprising at least one tone generator and the controller, wherein the controller is connected to the plurality of performance terminals and the at least one tone generator and is adapted to control each of the performance terminals, and wherein the method comprises the steps of:

storing music data for performance in a storage unit of the controller, the music data including a plurality of performance parts;

assigning, by a performance control unit of the controller, the plurality of performance parts to respective ones of the plurality of performance terminals prior to performance;

reading out, by the performance control unit, a performance of the performance part assigned to each of the performance terminals in accordance with a way in which the performance operator unit of said each of said performance terminals is operated;

outputting, by the performance control unit, data representing the read-out performance(s) to the tone generator(s);

recording, by a record unit of the controller, whether each of the performance terminals participated in performance of the music data; and recording, by the record unit, a performance history for each of the performance terminals from start to completion of the performance of the music data, wherein the performance history includes information representing a number of times of and an average intensity of performance operation.

7. The ensemble method according to claim 6, wherein the performance history includes information representing an average deviation relative to the performance operation on a guide performance terminal among the performance terminal.

8. An ensemble method implemented by a controller in an ensemble system, the ensemble system comprising a plurality of performance terminals each having at least one performance operator unit used for performance operation, the ensemble system further comprising at least one tone generator and the controller, wherein the controller is connected to the plurality of performance terminals and the at least one tone generator and is adapted to control each of the performance terminals, and wherein the method comprises the steps of:

storing music data for performance in a storage unit of the controller, the music data including a plurality of performance parts;

assigning, by a performance control unit of the controller, the plurality of performance parts to respective ones of the plurality of performance terminals prior to performance;

reading out, by the performance control unit, a performance of the performance part assigned to each of the performance terminals in accordance with a way in which the performance operator unit of said each of said performance terminals is operated;

outputting, by the performance control unit, data representing the read-out performance(s) to the tone generator(s);

recording, by a record unit of the controller, whether each of the performance terminals participated in performance of the music data; and recording, by the record unit, a performance history for each of the performance terminals from start to completion of the performance of the music data, wherein the ensemble system further comprises a plurality of the tone generators, wherein one of the tone generators is built in each of the plurality of performance terminals, wherein the method further comprises outputting, by the performance control unit, information on the read-out performance part to the tone generator built in the performance terminal to which the performance part is assigned, and wherein the performance history includes information representing a number of times of and an average intensity of performance operation.

* * * * *